US011253868B2

(12) United States Patent
Wannop

(10) Patent No.: US 11,253,868 B2
(45) Date of Patent: Feb. 22, 2022

(54) GOLD PANNING MACHINE

(71) Applicant: George Wannop, Kelowna (CA)

(72) Inventor: George Wannop, Kelowna (CA)

( * ) Notice: Subject to any disclaimer, the term of this patent is extended or adjusted under 35 U.S.C. 154(b) by 177 days.

(21) Appl. No.: 16/472,821

(22) PCT Filed: Dec. 22, 2017

(86) PCT No.: PCT/CA2017/051602
§ 371 (c)(1),
(2) Date: Jun. 21, 2019

(87) PCT Pub. No.: WO2018/112668
PCT Pub. Date: Jun. 28, 2018

(65) Prior Publication Data

US 2020/0086327 A1 Mar. 19, 2020

Related U.S. Application Data

(60) Provisional application No. 62/498,334, filed on Dec. 22, 2016.

(51) Int. Cl.
*B03B 5/02* (2006.01)

(52) U.S. Cl.
CPC ..... *B03B 5/02* (2013.01)

(58) Field of Classification Search
CPC ..... B03B 5/02
USPC ..... 209/269
See application file for complete search history.

(56) References Cited

U.S. PATENT DOCUMENTS

| | | | |
|---|---|---|---|
| 4,988 | A | 2/1847 | Sullivan |
| 4,496 | A | 5/1849 | Ashbury |
| 8,344 | A | 9/1851 | Ball |
| 10,282 | A | 11/1853 | Edwards |
| 23,881 | A | 5/1859 | Cavanah |
| 44,130 | A | 9/1864 | Wheeler |
| 60,089 | A | 11/1866 | Thompson |
| 62,749 | A | 3/1867 | Hungerford |
| 3,320 | A | 3/1869 | Wheeler |
| 128,628 | A | 7/1872 | Hungerford |
| 196,651 | A | 10/1877 | Frue et al. |

(Continued)

OTHER PUBLICATIONS

International Searching Authority, The International Search Report and the Written Opinion of the International Searching Authority, or the Declaration, International Application No. PCT/CA2017/051602, Filed Dec. 22, 2017, 9 pages, Receiving Office—Canadian Intellectual Property Office.

*Primary Examiner* — Terrell H Matthews

(74) *Attorney, Agent, or Firm* — Oyen Wiggs Green & Mutala LLP; Paul Smith

(57) ABSTRACT

An apparatus and method for separating heavy metals and precious stones from alluvial material wherein the apparatus comprises a frame, a gold pan supported on the frame and a vibration means supported on the frame adapted to provide a vibration to the gold pan. The apparatus may further comprise a water pump supported on the frame operable to introduce a quantity of water to the gold pan. The apparatus may further comprise a screen supported above the gold pan. The method comprises providing a gold pan supported on a frame, introducing a quantity of an alluvial material to the gold pan and vibrating the gold pan so as to remove lighter material leaving the heavy metals and precious stones therein.

19 Claims, 6 Drawing Sheets

(56) References Cited

U.S. PATENT DOCUMENTS 207,622 A 9/1878 Plant
246,183 A 8/1881 Mitchell
265,766 A 10/1882 De La Cerde
270,492 A 1/1883 Seymour
283,296 A 8/1883 Charles
285,098 A 9/1883 Anderson
330,817 A 11/1885 Boardman
352,578 A 11/1886 Shaw
368,683 A 8/1887 Pemberton
394,654 A 12/1888 Jones
398,863 A 3/1889 Taylor
420,933 A 2/1890 Gates
450,013 A 4/1891 Hammond et al.
450,063 A 4/1891 Fitch
473,506 A 4/1892 Iler
481,550 A 8/1892 Dana
524,586 A 8/1894 Fitch
532,956 A 1/1895 Hammond et al.
537,945 A 4/1895 Tarrant
632,032 A 8/1898 Wees
611,346 A 9/1898 Anderson
612,034 A 10/1898 Grimes
613,172 A 10/1898 Newberry
654,661 A 7/1900 Mitchell
668,980 A 2/1901 Christensen
972,413 A 4/1901 Burke
679,155 A 7/1901 Montgomery
694,255 A 2/1902 Dana
764,197 A 7/1904 Muhleman
766,060 A 7/1904 Parker
777,837 A 12/1904 Cammett
791,711 A 6/1905 Morgan
793,945 A 7/1905 Marshall
796,110 A 8/1905 Cammett
845,395 A 2/1907 Christmann
859,354 A 7/1907 Wall
898,119 A 9/1908 Lins
933,633 A 9/1909 Dieu
941,634 A 11/1909 Godley
1,007,116 A 10/1911 King
1,056,923 A 3/1913 Marcy
1,065,288 A 6/1913 Witton
1,090,448 A 3/1914 Case
1,098,183 A 5/1914 Signorette
1,141,419 A 6/1915 Senn
1,148,591 A 8/1915 King
1,172,171 A 2/1916 Senn
1,176,735 A 3/1916 Conley
1,185,611 A 5/1916 Dougan
1,241,954 A 10/1917 Furtado
1,263,968 A 4/1918 Vanderlip
1,303,233 A 5/1919 Bauer
1,309,307 A 7/1919 Small
1,314,370 A 8/1919 Small
1,314,371 A 8/1919 Small
1,443,608 A 1/1923 Bleakley
1,451,567 A 4/1923 Erickson et al.
1,470,011 A 10/1923 Johnesse
1,497,658 A 6/1924 Bielenberg et al.
1,525,718 A 2/1925 Charlton
1,536,236 A 5/1925 Morris
1,595,621 A 8/1926 Robbins
1,599,293 A 9/1926 Severance
1,631,434 A 6/1927 Smith
1,638,864 A 8/1927 Mathe et al.
1,947,877 A 2/1934 Rickel
1,987,475 A 1/1935 Hanson
2,006,596 A 7/1935 Mendenhall
2,049,962 A 8/1936 Lamberson
2,064,000 A 12/1936 Hartman
2,075,731 A * 3/1937 Walter ..... B03B 5/02 209/422
2,089,676 A 8/1937 Ulrich
2,122,822 A 7/1938 Noel
2,263,143 A 12/1941 Record
2,410,326 A 10/1946 Zeiglet et al.
2,484,203 A 10/1949 Beck
2,697,519 A 12/1954 Nash et al.
2,714,962 A 8/1955 Sides
2,715,462 A 8/1955 Coulter
2,715,463 A 8/1955 Fitch
2,812,063 A 11/1957 Pratt
2,874,841 A * 2/1959 Peterson ..... B07B 1/286 209/329
2,921,680 A 1/1960 Kreta
3,292,781 A 12/1966 Kjarval
3,706,377 A 12/1972 Blanicu
4,056,464 A 11/1977 Cross
4,077,873 A 3/1978 McKibben
4,111,797 A 9/1978 Richter
4,120,783 A 10/1978 Baummer
4,150,749 A 4/1979 Stevens
4,152,255 A 5/1979 Musschoot
4,251,357 A 2/1981 Wright
4,289,241 A * 9/1981 Litrap ..... B03B 5/02 209/44
4,289,270 A * 9/1981 Warsinske ..... B04B 1/02 494/27
4,319,985 A 3/1982 Hibbard
4,339,043 A * 7/1982 Tice ..... B03B 5/26 209/251
4,359,383 A 11/1982 Sweet
4,360,424 A 11/1982 Pearson et al.
4,361,480 A 11/1982 Corbus et al.
4,428,830 A 1/1984 Hepfner et al.
4,472,269 A 9/1984 Swick
4,512,881 A 4/1985 Shumway et al.
4,523,989 A 6/1985 Graefe
4,715,949 A 12/1987 Watts
4,778,219 A 10/1988 Wilczynski et al.
4,839,034 A 6/1989 Dahlberg
4,966,686 A 10/1990 Sherman
4,997,551 A 3/1991 Ponomarev
5,043,059 A 8/1991 Ponomarev
5,057,211 A 10/1991 Baummer
5,108,584 A 4/1992 Brosseuk
5,148,922 A 9/1992 Marriott
5,160,035 A 11/1992 McConnell
5,273,165 A 12/1993 Krenzler
5,275,294 A * 1/1994 Krenzler ..... B07B 13/11 209/434
5,421,461 A * 6/1995 Ruzic ..... B03B 5/02 209/332
5,788,293 A 8/1998 Krenzler
5,927,509 A 7/1999 Lord
5,957,301 A 9/1999 Wedel et al.
5,957,303 A 9/1999 Krenzler
6,102,211 A 8/2000 Krenzler
6,216,367 B1 4/2001 Tubbs
6,412,644 B1 7/2002 Crabbe et al.
6,799,681 B1 10/2004 Warren
6,907,996 B1 6/2005 Fraas
7,134,556 B1 11/2006 McCauley
7,533,775 B2 5/2009 King et al.
7,845,498 B2 12/2010 Kauffman
7,909,169 B1 3/2011 Slade
8,399,790 B1 3/2013 Slade
8,770,412 B2 7/2014 Miller
D757,142 S * 5/2016 Pung ..... D15/147

* cited by examiner

GOLD PANNING MACHINE

BACKGROUND OF THE INVENTION

1. Field of Invention

This invention relates to the separation of gold particles from gold bearing alluvial material. More particularly, it relates to the provision of a gold pan machine which includes a frame on which is mounted a gold pan with a screen with a method of vibrating the gold pan and pumping water to the gold pan. It is compact with shoulder straps for backpacking distances and comprises a complete set-up in one lightweight unit.

2. Description of Related Art

Hand-held gold pans have been used for many years for separating gold particles from alluvial material. Depending on the experience of the person gold panning, the process can be slow and some of the gold particles can easily be lost in the process. Sluice boxes have also been used for many years which speed up the process but are generally bulky and heavy and can lose a significant percentage of the gold also depending on experience and how well it is set up regarding angle of slope and the amount of water flow.

SUMMARY OF THE INVENTION

According to a first embodiment of the present invention there is disclosed an apparatus for separating heavy metals and precious stones from alluvial material comprising a frame, a gold pan supported on the frame and a vibration means supported on the frame adapted to provide a vibration to the gold pan;

The frame comprises a plurality of base members and a plurality of cross-members which span between and connect the base members together, the cross-members providing a raised central section.

The apparatus may further comprise a plurality of flexible mounts fastened on top of the raised central section of the frame for operably supporting the gold pan.

The apparatus may further comprise a platform mounted on and retained by the plurality of flexible mounts, the platforms upper surface shaped to retain the gold pan from horizontal movement relative to the platform, and wherein a side portion of the platform is formed to connect the platform to the vibration means causing the platform and the gold pan to vibrate relative to the frame.

The vibration means may be comprised of a bearing connected to the platform, the bearing mounted on an offset-from-center portion of a cam and the cam mounted on a shaft rotated by the drive means, thus when the drive means rotates the shaft, the shaft rotates the cam and moves the bearing in an eccentric circle vibrating the platform.

The gold pan may be bowl shaped with a generally flat central bottom section and sides extending upward on an outward angle and a top circumferential rim extending horizontally outward, and a spillway formed on the front side of the gold pan, the spillway having a flat bottom, vertical sides, and an open front allowing lighter material to flow out.

The apparatus may further comprise a hinge bracket attached to the front section of the platform formed with two vertical ends each with a circular hole formed near their top ends and wherein the gold pan spillway is retained between the vertical ends of the hinge bracket.

The apparatus may further comprise a gold pan retaining bracket attached to the back end of the platform with a raised horizontal flat portion for the back rim of gold pan to sit on, and further comprising a lock block fastened onto the top vertical end section of the gold pan retaining bracket providing a locking slot between the bottom of the lock block and the top of the horizontal flat portion and wherein when the gold pan rim is pushed down against an inside sloped face of the lock block, the gold pan retaining bracket flexes outward and when the gold pan rim lines up with the locking slot the gold pan retaining bracket springs back inward locking the gold pan rim into the locking slot.

The apparatus may further comprise a rectangular pan release lever wherein the lower portion of the release lever is pivotally retained in vertical slots formed in the rear face of the lock block with the release levers lower horizontal end positioned in the locking slot wherein when the top of the release lever is pressed outward the release levers mid-section presses against the top end of the gold pan retaining bracket pivoting the lower end of the release lever to move inward through the locking slot to push the gold pans rim out of the locking slot for removal of the gold pan.

The apparatus may further comprise a water pump supported on the frame operable to introduce a quantity of water to the gold pan. The apparatus may further comprise a water spray tube comprising an upper hollow portion for water flow and a lower portion formed to create a channel lengthwise on the bottom the spray tube. A length of the spray tube with the channel opening facing inward, is bent to a similar shape as the outer rim of the gold pan with its two end sections formed to follow the outer edge of the spillway sides on the gold pan. The ends of the spray tube bend at a right angle outward to act as hinge pins through the holes in vertical ends of the hinge bracket, the water spray tube further comprising several small holes on its inward face to spray water inward, and wherein the right angle bend section of the spray tube ends hold down the gold pan spillway.

The apparatus may further comprise a screen supported above the gold pan. The screen may be cut in the shape of the spray tube channel wherein the screens edge is fitted into and retained by the channel when the threaded ends of the spray tube are fitted through the holes in the vertical ends of the hinge bracket and therein also providing a screen spillway on the flat section of screen between the two ends of the spray tube, and therefore also providing alignment and pivoting of the spray tube and the screen allowing the screens opposite end to be tilted up so large gravel will roll through and off the screen spillway while small material will fall through the screen holes into the gold pan, and wherein one of the water spray tube ends is connected with a flexible hose to the water pump, and the other end of the water spray tube is sealed closed.

The apparatus may further comprise a heavy formed wire screen support pivotally attached to a screen support hinge fastened to the back end of the screen, wherein the screen support extends downward over outer face of the top vertical end section of the gold pan retaining bracket and wherein a bolt extending through the lock block and the top vertical end section of the gold pan retaining bracket extends outward on which a locking clamp with a central hole is retained, the locking clamp having wings bent inward over the screen support wire, and further comprising a threaded retaining knob threaded onto the end of the bolt wherein when the retaining knob is tightened against the locking clamp the screen support wire is locked in that position against the top vertical end section of the gold pan retaining bracket and when the retaining knob and the locking clamp are loosened the screen support wire can slide through the clamp to raise or lower rear portion of the spray tube and the screen.

Each of the flexible mounts may have a threaded stud extending downward from its lower end through holes in a raised area of the frame fastened with a locknut and a threaded stud extending upward from its upper end through holes in the platform fastened with a locknut.

According to a further embodiment of the present invention there is disclosed a method for separating heavy metals and precious stones from alluvial material comprising providing a gold pan supported on a frame, introducing a quantity of an alluvial material to the gold pan and vibrating the gold pan so as to remove lighter material leaving the heavy metals and precious stones therein.

The gold panning machine of the present invention is characterised by a gold pan mounted onto a platform which is supported by flexible supports mounted to a frame. The platform has a recess or hole centrally located in its top creating a seat to position and horizontally retain a gold pan. The gold pan has a spillway on one side raised above the bottom of the pan. A hinged screen with a spillway is mounted to the platform and extends over the top of the pan to separate and discard large material when it is locked into a tilted position. A water spray tube is attached around the top circumference of the screen. The frame is formed with lengthwise tubes to rest on the ground and a plurality of cross tubes connected to and extending across between the lengthwise tubes joining them together. A transmission is mounted between two of the cross tubes. An engine mounted to the transmission provides drive to the transmission and to a water pump mounted on the transmission which supplies water to the screen through the spray tube. The transmission drives a cam shaft. A cam, a bearing and a flexible cam cap on top of the bearing is connected to the platform to vibrate the platform, pan and screen.

In use, the engine drives the water pump to supply water to the screen and drives the transmission to vibrate the platform, pan and screen. The screen is locked into a tilted upward position. Gold bearing gravel is shovelled onto the screen where large gravel slides out the spillway and small gravel falls through the screen into the pan. The vibration and water in the pan causes the heaviest particles including gold to drift down and settle to the bottom of the pan. When the volume of gravel in the pan exceeds the height of the spillway on the pan, the lighter gravel will drift through and fall out of the spillway on the pan. Continue to shovel material onto the screen for any length of time and the heaviest metals and stones will continue to accumulate in the bottom of the pan. To finish and recover the gold, remove the pan from the platform and separate the gold from the remaining gravel panning by hand.

In one form the base of the machine is a frame formed with lengthwise tubes to rest on the ground and a plurality of cross tubes connected to and extending across between the lengthwise tubes joining them together to form a frame. The cross-tubes are formed to extend downward at each end with a flat center section creating a raised support area on each cross tube. The sample shown in the drawing has three cross tubes. Backpack cross straps fastened to the lengthwise tubes provide frame reinforcement and shoulder straps are fastened to the cross tubes. Central between and connected to two of the cross tubes is a structural member which provides a transmission mount. The transmission is mounted with bolts and nuts on top of the transmission mount. The engine is mounted onto one side of the transmission. The water pump is mounted onto the other side of the transmission. The water pump has a water intake hose and an outlet hose which sends pressurised water to a spray tube attached to the top of the screen. A valve is fitted into the water line leading to the spray tube for adjustment of the water flow. The transmission transmits rotational drive from the engine to a cam shaft which spins a cam with a bearing attached to its top offset-from-center portion.

The four flexible mounts may be attached to the top of the flat sections of two of the cross tubes by means of a threaded stud molded into the bottom of each flexible mount extending through a hole in the cross tube and a nut fastened to the threaded stud protruding through the bottom of the cross tube. A similar stud is molded into the top of each flexible mount with its threaded stud pointing upward through four mount retainer holes, one close to each corner of the platform and nuts threaded onto each stud to retain the platform. The platform has a formed pocket or hole which rests on top of and around the sides of the bearing and rubber cap so that the rubber cap is snugly fitted inside of the formed pocket, thus when the cam shaft is spinning the cam vibrates the bearing and rubber cap which vibrates the whole platform. The platform has a large central hole sized to fit in the bottom of the gold pan snugly. The pan is bowl shaped with a flat bottom and a spillway extends out of its front side to keep the material being panned confined and allowed to flow out through the spillway only. A hinge bracket is fastened to the front edge of the platform with bolts and nuts with its two ends bent upward at a right angle to a bottom flat portion attached to the platform. The vertical ends each have a hole large enough to serve as a pivot sleeve around a pipe fitting. The screen is formed with a top rim extending radially outward and has a spillway formed on the front side. A water spray tube extends around and is fastened to the top edge of the screen. Water spray holes are located around the inner face of the spray tube to spray water toward the center of the screen. The left end of the spray tube is fitted through the hole in the left hand vertical end of the hinge bracket with a threaded end protruding out and an end cap threaded on. This end cap can be removed for washing out debris in the tube. The right end of the spray tube is fitted through the hole in the right hand vertical end of the hinge bracket with a threaded end protruding out and a water supply hose from the water pump threaded onto it. The spray tube ends act as hinge pins through the bracket thus providing the screen and spray tube to be pivotally retained in their position allowing the back end of the screen and spray tube to be pivoted up. An adjustable screen support is pivotally attached to the rear side of the screen. It is a formed piece of heavy wire extending down from the rear wall of the screen. A locking clamp has wings extending over the wire to press against the wire and lock it in place against a support bracket when a retaining knob on the bolt of the locking clamp extending through a hole in the support bracket is tightened. The screen support allows the screen to be pivoted up and locked at the desirable angle. The gold pan can be installed or removed when the screen is in a raised position. Install by sliding the spillway section between the vertical ends of the screen hinge bracket where the two ends of the spray tube hold it down in the correct position, then push down on the back end of the pan until the pan rim locks down under the front edge of the pan lock block. To remove the pan press down on the outer top end of the release lever, this pivots the lever against the top of the screen support bracket pushing the bottom end of the lever forward against the pan rim and kicking the pan out of the locking slot at which time the pan pops upward and is released for removal by lifting the pan up and out to one side.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
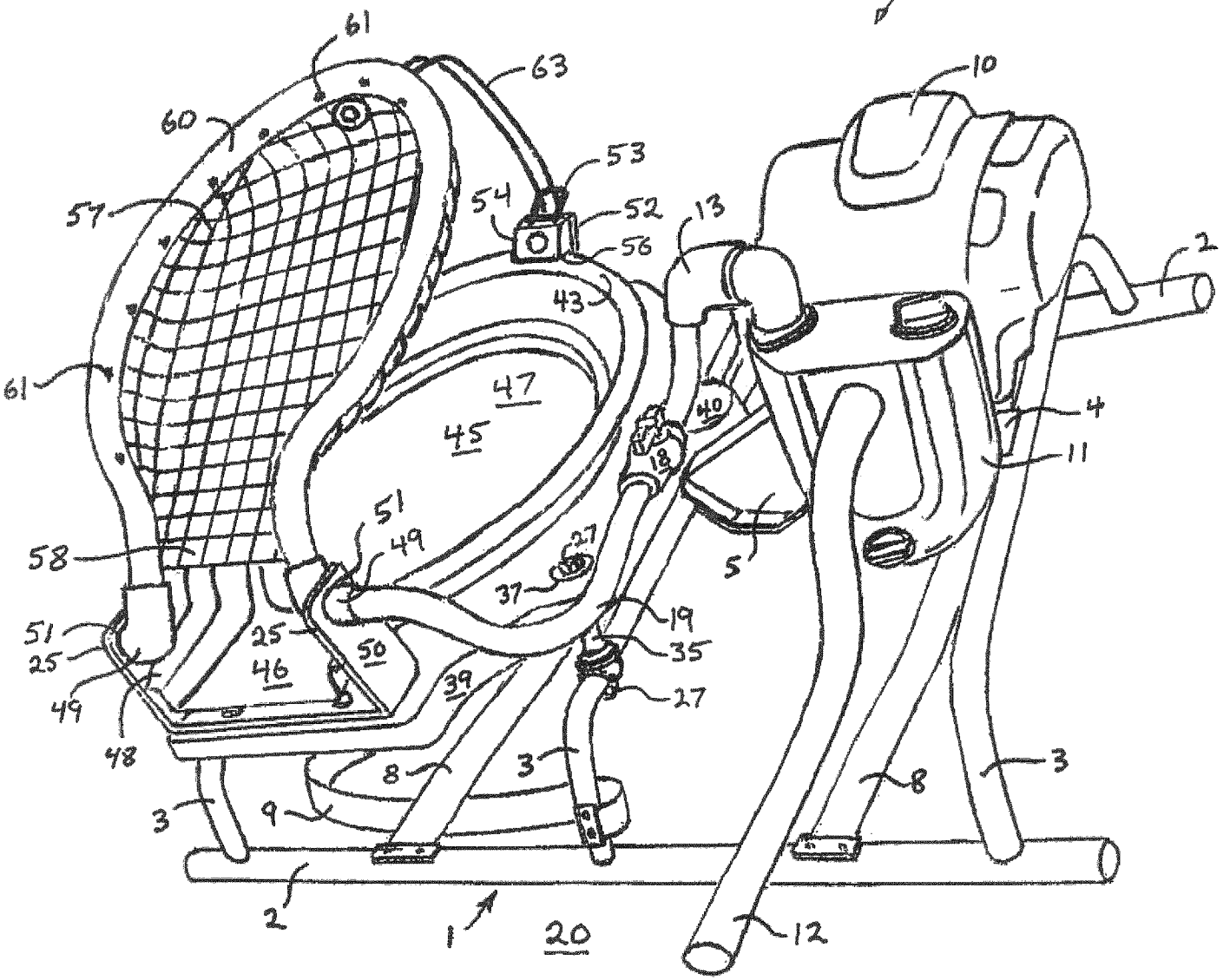
FIG. 1 is a front perspective view of an apparatus for separating heavy metals and precious stones from alluvial material according to a first embodiment of the present invention.

Referring to FIG. 1 an apparatus for for separating heavy metals and precious stones from alluvial material according to a first embodiment of the invention is shown generally at 100. The apparatus 100 or gold panning machine comprises a frame supporting a gold pan 45 adapted to be vibrated by a vibration source and a means for introducing water into the pan.

The base of the machine is a frame 1 best shown in FIG. 1 formed with two lengthwise tubes 2 to rest on the ground and a plurality of cross tubes 3 connected to and extending across between the lengthwise tubes 2 joining them together to form frame 1. The cross tubes 3 are formed to extend downward at each end with a flat center section creating a raised support area on each cross tube 3. The sample shown in FIG. 1 has three cross tubes 3 although it will be appreciated that more or less may also be utilized. Backpack cross straps 8 have each end fastened to one of lengthwise tubes 2 to also act as a frame reinforcement and shoulder straps 9 are fastened to cross tubes 3. Central between and connected to two of the cross tubes 3 is a structural member which provides a transmission support 4 best shown in FIG. 2.

Figure 2:
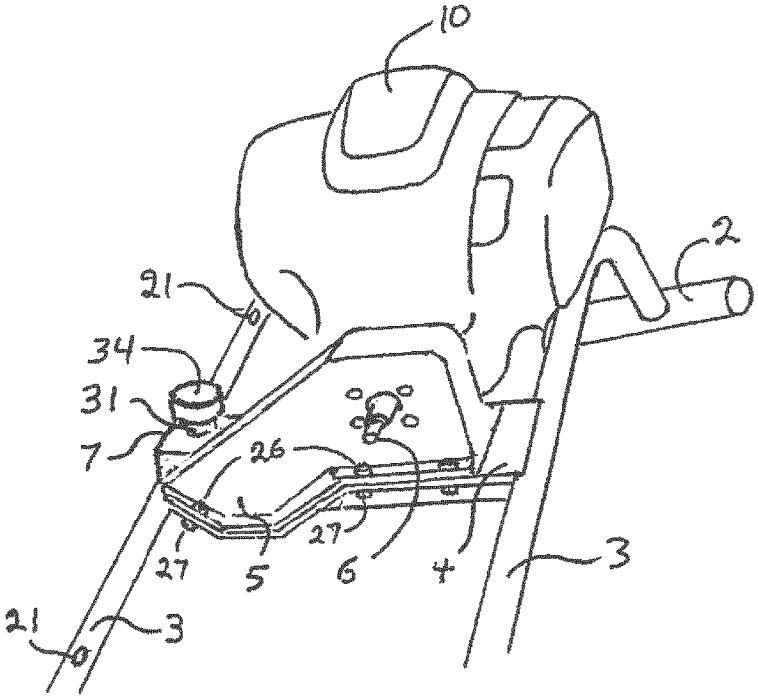
FIG. 2 is a perspective view of the engine and transmission of the apparatus of FIG. 1 with the water pump removed.

As illustrated in FIG. 2, a transmission 5 is mounted to the top of support 4 and retained by carriage bolts 26 and locknuts 27. Transmission 5 contains a plurality of pulleys and/or gears and at least one belt which transmit rotational drive from engine drive shaft 6 to gear box 7 which converts the horizontal rotation to vertical rotation out through cam shaft 31 best shown in FIG. 3 through a reduction therein so as to provide the desired rotational speed as is commonly known.

In FIG. 2 engine 10 is mounted onto one side of transmission 5 and water pump 11 in FIG. 1 is mounted onto the other side of transmission 5 and has a water intake hose 12 and an outlet hose 13. A valve 18 is fitted onto outlet hose 13 for adjustment of the water flow. Flex hose 19 carries water from valve 18 to spray tube 60.

Figure 3:
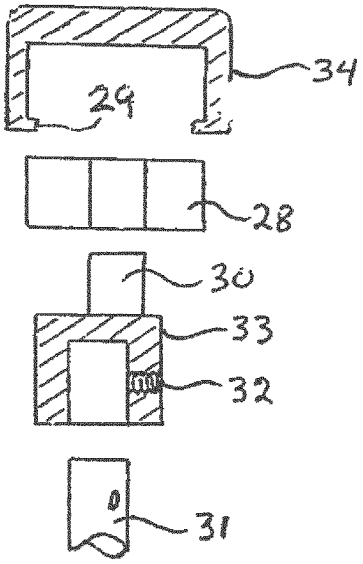
FIG. 3 is an exploded cross sectional view of the cam shaft, cam, ball bearing and cam cap of the apparatus of FIG. 1.

Cam 33 in FIG. 3 is a short hollow round section of machined steel which has an offset-from-center round stub 30 extending upwards from its top and is attached by set screw 32 onto the top of cam shaft 31. Ball bearing 28 is press fit onto round stub 30. Cam cap 34 is preferably formed rubber which has a recess in its bottom surface to fit snugly over ball bearing 28. Cam cap 34 also has an inwardly protruding ridge 29 at the opening of the recess to retain cam cap 34 on ball bearing 28 once pressed on.

Figures 5, 6, 7:
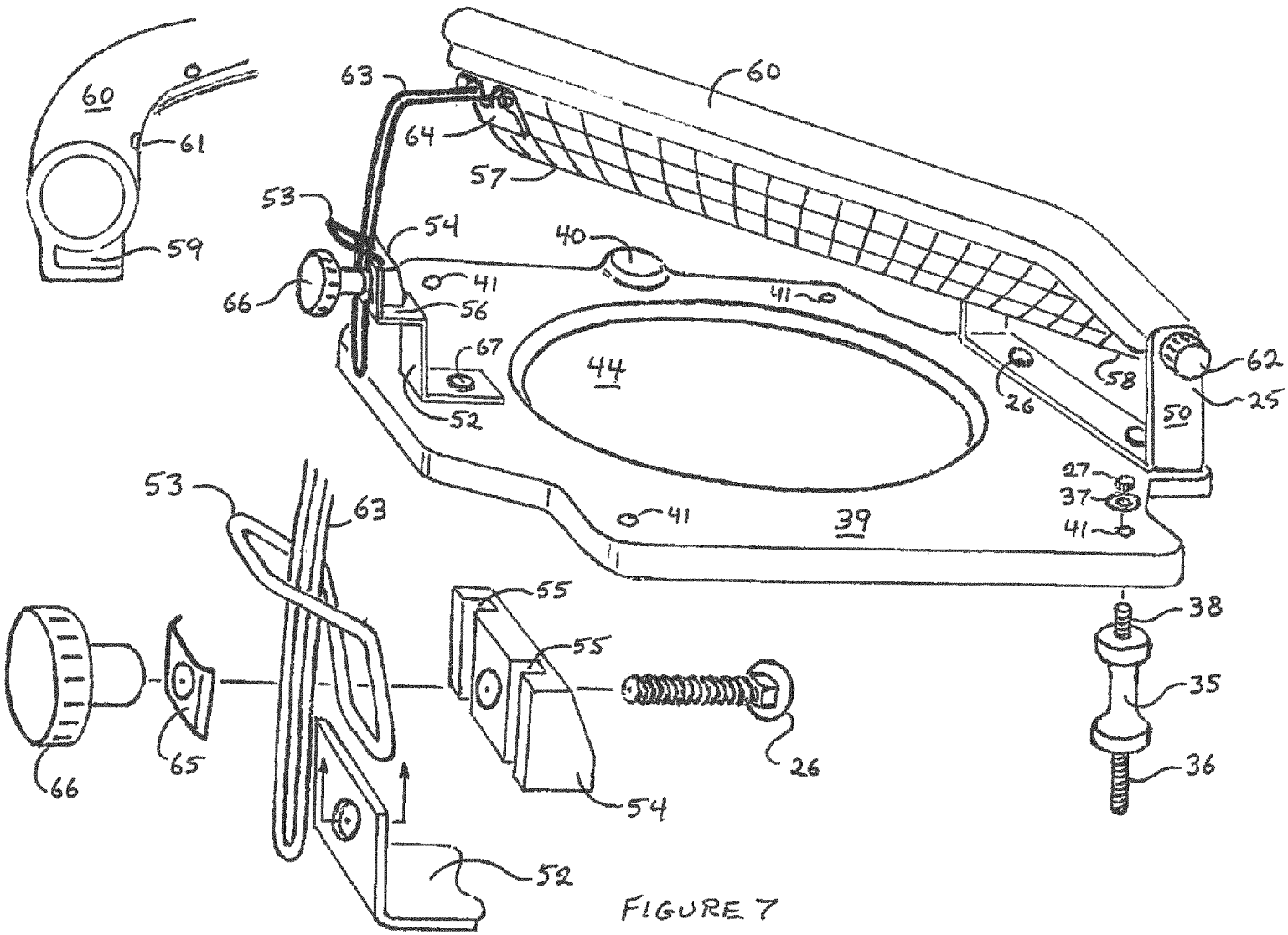
FIG. 5 is a rear perspective view of the platform, screen, screen support, hinge and pan locking mechanism of the apparatus of FIG. 1.
FIG. 6 is a detailed cross section of the water spray tube of the apparatus of FIG. 1.
FIG. 7 is a detailed exploded view of the adjustable screen support and lock, and pan locking block and release lever of the apparatus of FIG. 1.

Four flexible mounts 35 with threaded studs 36 and 38 protruding from the bottom and top of mounts 35 in FIGS. 1 and 5 are mounted on the top horizontal sections of two of cross tubes 3 with studs 36 extending down through holes 21 in cross tubes 3 and retained with lock nuts 27.

Platform 39 in FIGS. 1 and 5 is formed with a hole 41 close to each corner. The four studs 38 of mounts 35 protrude up through holes 41 and lock nuts 27 and washers 37 fasten platform 39 to the tops of mounts 35. Platform 39 has a formed pocket or hole 40 which snugly fits over cam cap 34 in FIGS. 2 and 3 thus when cam shaft 31 is spinning cam 33 vibrates bearing 28 and cam cap 34 which vibrates platform 39. In FIG. 5 platform 39 has a large central hole 44 sized to seat and horizontally retain gold pan 45 snugly.

Figure 4:
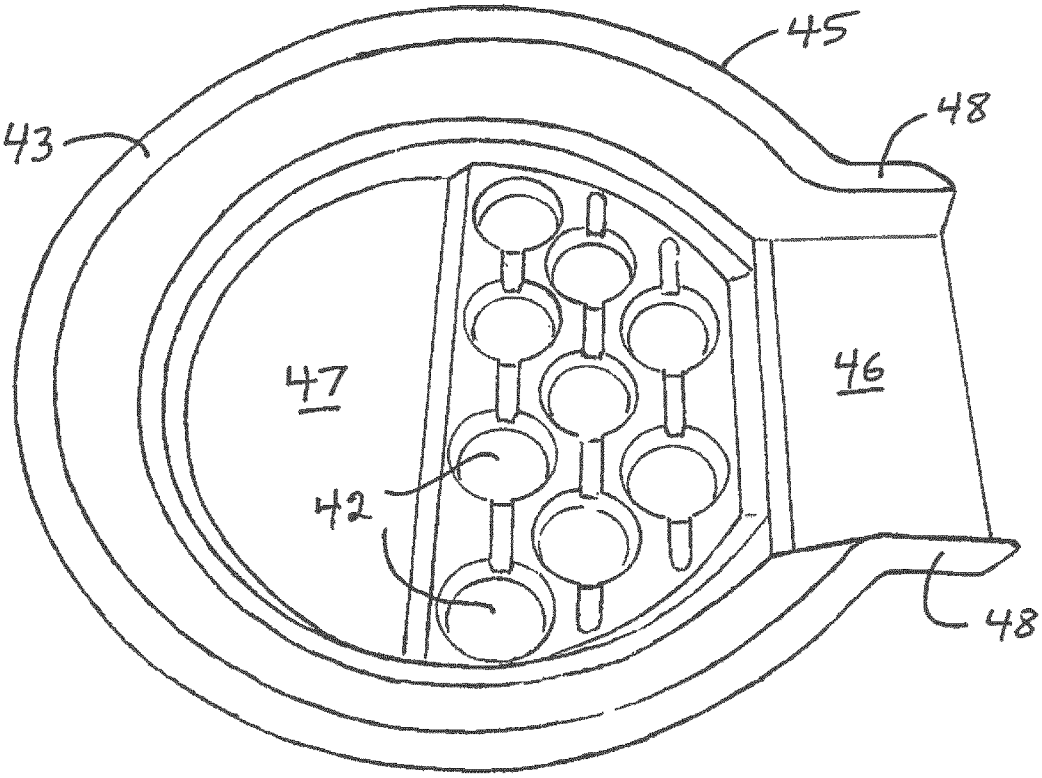
FIG. 4 is a perspective view of the gold pan or receptacle of the apparatus of FIG. 1.

Gold pan 45 best shown in FIG. 4 is bowl shaped with a flat bottom 47 and a spillway 46 above the level of bottom 47 which extends out from the front side of pan 45 to keep the material being panned confined and allowed to flow out through spillway 46 only. The spillway 46 has a reduced height from the bottom 47 relative to the rim 43 therearound so as to direct removed water and material out of the gold pan 45 therethrough. In practice it has been found that a height of between ½ and 1 inch (13 and 25 mm) above the bottom 47 has been useful although it will be appreciated that other dimensions may be useful as well. The top edge of pan 45 is a circumferential rim 43 extending radially outwards. Bottom 47 has formed pockets or contours 42 designed to act as riffles to trap heavy particles.

Hinge bracket 50 in FIG. 1 and FIG. 5 is preferably a metal strip with its two ends 25 bent upward at a right angle to the bottom flat portion which is fastened to the front edge of platform 39 with bolts 26 and lock nuts 27. Vertical ends 25 of hinge bracket 50 each have a hole 51 large enough to act as a pivot sleeve around the outside circumference of each end of spray tube 60 allowing the ends of spray tube 60 to be positioned through holes 51 providing spray tube 60 and screen 57 to be pivotally retained in their position.

Screen 57 in FIG. 1 is a formed pan shape with spillway 58 formed on the front side of it. Although the screen 57 is illustrated as shaped to correspond to the shape of the gold pan 45, it will be appreciated that other shapes may be useful as well provided that the screen 57 is located thereover so as to be operable to prevent rocks and larger particles from being located in the gold pan.

Spray tube 60 in FIGS. 5 and 6 has a lengthwise retaining slot 59 formed in its bottom section to retain screen 57 whereby the circumferential radially outward extending edge of screen 57 fits snugly in retaining slot 59 in FIG. 6 thus when spray tube 60 is installed and spray tube ends 49 fitted into holes 51 the screen is permanently held. Spray tube holes 61 are located around the inner face of spray tube 60 to spray water toward the center of screen 57. Viewed from the front, 20, the left end of spray tube 60 is fitted through hinge bracket hole 51 with a threaded end 49 protruding out and end cap 62 threaded on in FIG. 5. End cap 62 can be removed for washing out debris in spray tube 60. The right end of spray tube 60 in FIG. 1 is fitted through hinge bracket pivot hole 51 with threaded end 49 of spray tube 60 protruding out and flex hose 19 threaded onto it. This allows spray tube 60 and screen 57 to be pivoted up while water is being sprayed in through spray tube 60. Therefore ends 49 of spray tube 60 also act as the hinge pins.

Adjustable screen support 63 in FIGS. 1, 5, and 7 is pivotally attached by support hinge 64 to the rear side of screen 57. Support hinge 64 is fastened to rear side of screen 57. Screen support 63 is a formed piece of heavy wire extending down from the rear of screen 57. Locking clamp 65 on carriage bolt 26 has wings extending over the wire of support 63 to press against the wire and lock it in place against support bracket 52 when threaded retaining knob 66 is tightened on outer end of carriage bolt 26. Screen support 63 allows screen 57 to be pivoted up and locked at the desirable angle.

Gold pan 45 can be installed or removed when screen 57 is in a raised position. Install by sliding spillway 46 between vertical ends 25 of screen hinge bracket 50 where the two ends 49 of spray tube 60 hold spillway 46 down in the correct position, then push down on the back end of pan 45 until pan rim 43 locks down under the front edge of pan lock block 54. To remove pan 45 press down on the outer top end of release lever 53, this presses the mid-section of lever 53 against the top edge of screen support bracket 52 pushing the bottom end of lever 53 forward against pan 45 and kicking pan 45's rim 43 out of locking slot 56 at which time pan 45 pops upward and is released for removal by lifting pan 45 up and out to one side.

The operation of the machine will now be described. Set the machine in a roughly level position on the ground. Best shown in FIG. 1 the end of the water intake hose 12 is submerged in water. Prime water pump 11 by filling the reservoir with water. Start engine 10. This drives water pump 11 sending water to spray tube 60 and through holes 61 and rotates cam shaft 31 to vibrate platform 39, gold pan 45, and screen 57. Loosen screen support clamp knob 66 and tilt up screen 57 to the desired angle and retighten knob 66. Gold bearing material can now be shovelled onto the top portion of screen 57. Material smaller than screen 57 hole size will fall through into gold pan 45 and anything larger will gradually roll out and off screen spillway 58. As material is continuously shovelled onto screen 57 gold pan 45 will be filled with the smaller gold bearing material and water up to the level of pan spillway 46. The vibration of gold pan 45 will settle the heaviest particles to the bottom of pan 45 while the lightest material will circulate at the top and gradually fall out through pan spillway 46. Continue to shovel material onto screen 57 for any length of time and the heavy metals and stones will continue to accumulate in the bottom of gold pan 45. When finishing, press lever 53 to release gold pan 45 which can then be lifted out and final panning out of remaining material done by hand to reduce it down to the heaviest metals and stones at the bottom.

Figure 8:
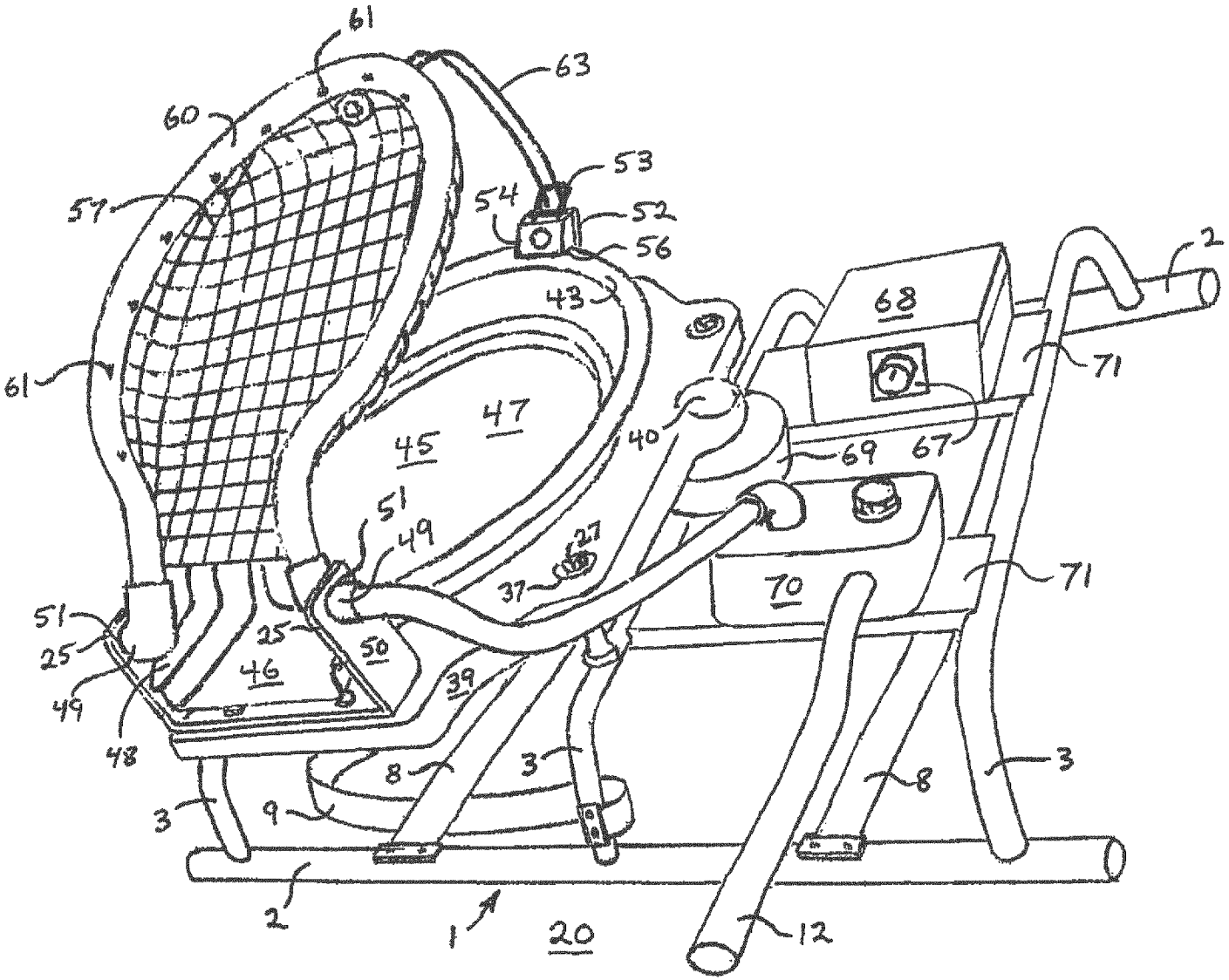
FIG. 8 is a front perspective view of an apparatus for separating heavy metals and precious stones from alluvial material according to a further embodiment of the present invention.

In an alternate embodiment of the machine shown in FIG. 8, an electric motor 69, electric water pump 70 and battery 68 replaces engine 10, water pump 11 and transmission 5. A switch and rheostat 67 is mounted on the machine to control the vibration and pump speed.

Figure 9:
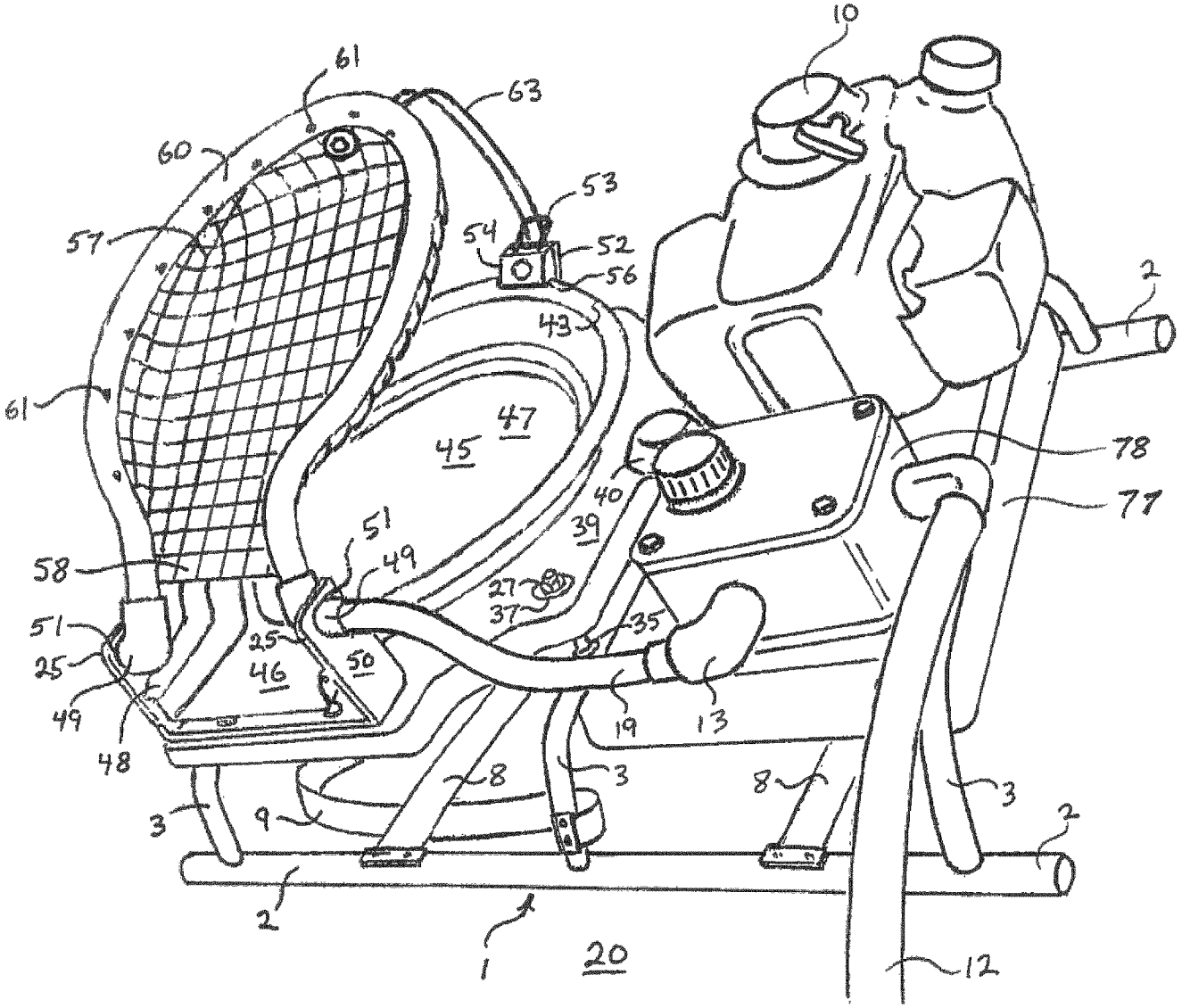
FIG. 9 is a front perspective view of an apparatus for separating heavy metals and precious stones from alluvial material according to a further embodiment of the present invention.

In a second alternate embodiment of the machine shown in FIG. 9, horizontal transmission 77 can be substituted for transmission 5 and gearbox 7 wherein engine 10 is mounted with its shaft extending vertically downward into transmission case 77 to drive a plurality of pulleys and belts which drive water pump 78 and cam shaft 31.

Figure 10:
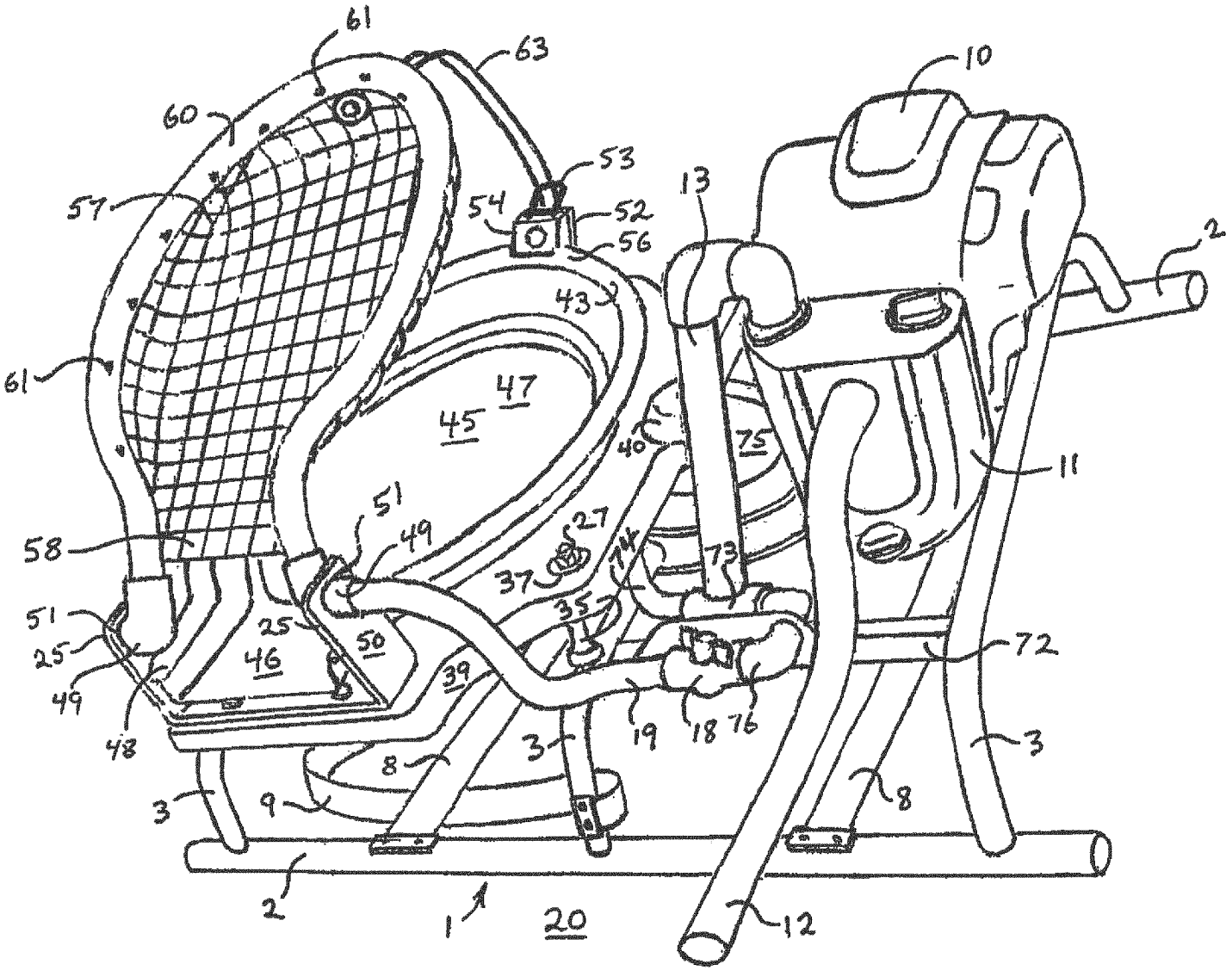
FIG. 10 is a front perspective view of an apparatus for separating heavy metals and precious stones from alluvial material according to a further embodiment of the present invention.

In a third alternate embodiment of the machine shown in FIG. 10, turbine 75 can be substituted for transmission 5 and gearbox 7. Pipe 76 directs water from tee 73 to valve 18 for adjustment of the water flow. Flexible hose 19 carries water from valve 18 to spray tube 60. Hose 74 carries water from the other outlet of tee 73 to turbine 75. Turbine 75 is similar in operation to a Pelton Wheel having spoons which catch the force of a water spray to create rotational movement through camshaft 31. Cam shaft 31 in FIG. 3 extends upward from turbine 75.

It will be appreciated that the vibration of the platform, pan and screen could be produced with an unbalanced spinning wheel instead of a cam. It will be further appreciated that this machine may be used for dry panning in desert areas where a water pump and spray tube would not be needed. It will be further appreciated that this machine is described as being used for isolation of gold, but it may be used just as well for isolation of any other precious metals or stones such as platinum, diamonds etc.

While specific embodiments of the invention have been described and illustrated, such embodiments should be considered illustrative of the invention only and not as limiting the invention as construed in accordance with the accompanying claims.

What is claimed is:

1. Apparatus for separating heavy metals and precious stones from alluvial material comprising:

a frame;

a receptacle having a bottom that is substantially level and even with regard to a horizontal plane and a side wall extending around said bottom for receiving a quantity of alluvial material in said receptacle;

a spillway in a portion of said side wall, said spillway being spaced above the substantially level and even bottom of the receptacle, the spillway defining a base portion of the receptacle below the spillway, said spillway allowing excess alluvial material to exit the receptacle when the material in the receptacle exceeds a volume defined in said base portion below the spillway;

said receptacle being supported on said frame by flexible mounts allowing vibratory movement of said receptacle in relation to said frame;

vibration means supported on said frame and adapted to provide vibration to said receptacle; and, wherein when alluvial material is successively received in said receptacle, said vibratory movement causes a heavier portion of the alluvial material to be retained in said base portion of said receptacle and a lighter portion of the alluvial material to be displaced upward within said base portion of the receptacle and to be pushed out of the receptacle through said spillway.

2. The apparatus of claim 1 further comprising a water pump supported on said frame operable to introduce a quantity of water to said receptacle from a water source.

3. The apparatus of claim 2 further comprising a spray tube above said receptacle in fluidic communication with said water pump, said spray tube having outlets positioned to discharge water onto said receptacle.

4. The apparatus of claim 3 further comprising a screen supported by said spray tube wherein said spray tube is formed with a lengthwise inward facing channel below said outlets adapted to retain an edge of said screen.

5. The apparatus of claim 4 wherein said spray tube extends from distally opposed and oriented ends extending away from each other so as to provide a hinge for tilting said spray tube and screen.

6. The apparatus of claim 3 wherein said spray tube is semi-circular in length and having a shape corresponding to an outline of said receptacle.

7. The apparatus of claim 1 further comprising a plurality of flexible mounts fastened to said frame for flexibly supporting said receptacle.

8. The apparatus of claim 7 further comprising a platform supported by said flexible mounts having a central hole sized to receive said receptacle therein.

9. The apparatus of claim 8 wherein said vibration means comprises a rotating cam having an eccentrically located protrusion engaged with a bearing connected to said platform.

10. The apparatus of claim 1 wherein said side wall extends upward at an outward angle from said bottom.

11. The apparatus of claim 10 wherein said bottom includes contours formed thereinto proximate to said spillway.

12. The apparatus of claim 10 wherein said spillway has a horizontal bottom and sidewalls extending upwards therefrom, with an opening allowing lighter material to flow out of said receptacle.

13. The apparatus of claim 1 wherein said frame comprises a plurality of base members and cross members wherein said receptacle is supported thereabove, said frame further comprising shoulder straps extending from said base members so as to permit said frame to be carried on the back of a user.

14. The apparatus of claim 13 wherein said platform includes a lock for selectably securing said receptacle in said central hole.

15. A method of separating heavy metals and precious stones from alluvial material comprising:

providing an apparatus having a frame;

a receptacle flexibly supported on said frame for vibratory movement of said receptacle in relation to said frame;

vibration means supported on said frame and adapted to provide vibration to said receptacle;

said receptacle having a bottom that is substantially level and even with regard to a horizontal plane and a side wall extending around said bottom for receiving a quantity of alluvial material in said receptacle; and, a spillway extending through a portion of said side wall, said spillway spaced above said bottom to define a base portion of said receptacle to retain a volume of alluvial material in said base portion below said spillway;

installing said apparatus in the vicinity of alluvial material such that said bottom of said receptacle is substantially horizontally level;

introducing a quantity of alluvial material in said receptacle while causing said receptacle to vibrate in relation to said frame, said bottom remaining substantially horizontally level;

introducing a successive quantity of alluvial material in said receptacle while continuing to cause said receptacle to vibrate;

whereby said vibration causes a heavier portion of said alluvial material to settle in said base portion below said spillway and a lighter portion of said alluvial material to be displaced upward and out of the receptacle through said spillway.

16. The method of claim 15 further comprising introducing water into said receptacle when introducing said successive quantity of alluvial material.

17. The method of claim 16 wherein introducing water comprises spraying water.

18. The apparatus of claim 1 wherein said bottom of said receptacle is substantially circular.

19. The apparatus of claim 2 wherein said bottom of said receptacle is substantially circular.

* * * * *